US009728857B2

(12) United States Patent
Liou et al.

(10) Patent No.: US 9,728,857 B2
(45) Date of Patent: Aug. 8, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 222 days.

(21) Appl. No.: 14/576,768

(22) Filed: Dec. 19, 2014

(65) Prior Publication Data

US 2015/0263428 A1 Sep. 17, 2015

(30) Foreign Application Priority Data

Mar. 17, 2014 (CN) ..... 2014 1 0096878

(51) Int. Cl.

| | |
|---|---|
| ***H01Q 1/24*** | (2006.01) |
| ***H01Q 9/42*** | (2006.01) |
| ***H01Q 5/371*** | (2015.01) |

(52) U.S. Cl.
CPC ..... *H01Q 9/42* (2013.01); *H01Q 5/371* (2015.01); *H01Q 1/243* (2013.01)

(58) Field of Classification Search
CPC ..... H01Q 1/243; H01Q 1/38; H01Q 9/0421
USPC ..... 343/702, 872, 878
See application file for complete search history.

(56) References Cited

U.S. PATENT DOCUMENTS

2015/0102976 A1* 4/2015 Wong ..... H01Q 1/243 343/860

* cited by examiner

*Primary Examiner* — Dameon E Levi
*Assistant Examiner* — Collin Dawkins
(74) *Attorney, Agent, or Firm* — Steven Reiss

(57) ABSTRACT

An antenna structure includes a feed end plate, a ground end plate, a first radiator, a second radiator, and a metallic plate. The first radiator is coupled to the feed end plate. The second radiator is coupled to the ground end plate. The metallic plate is spaced from the first radiator and is couple the second radiator. The metallic plate includes a main sheet and at least one side sheet connected to the main sheet, a gap is defined between the main sheet and the first radiator, and the second radiator is coupled to the at least one side sheet.

14 Claims, 6 Drawing Sheets

ANTENNA STRUCTURE AND WIRELESS COMMUNICATION DEVICE USING THE SAME

FIELD

The subject matter herein generally relates to antenna structures, and particularly to a multiband antenna structure, and a wireless communication device using the same.

BACKGROUND

Multiband antennas are used in wireless communication devices such as mobile phones to receive/transmit wireless signals at different frequencies, such as wireless signals operated in an long term evolution (LTE) band.

BRIEF DESCRIPTION OF THE DRAWINGS

Implementations of the present technology will now be described, by way of example only, with reference to the attached figures.

DETAILED DESCRIPTION

Figure 1:
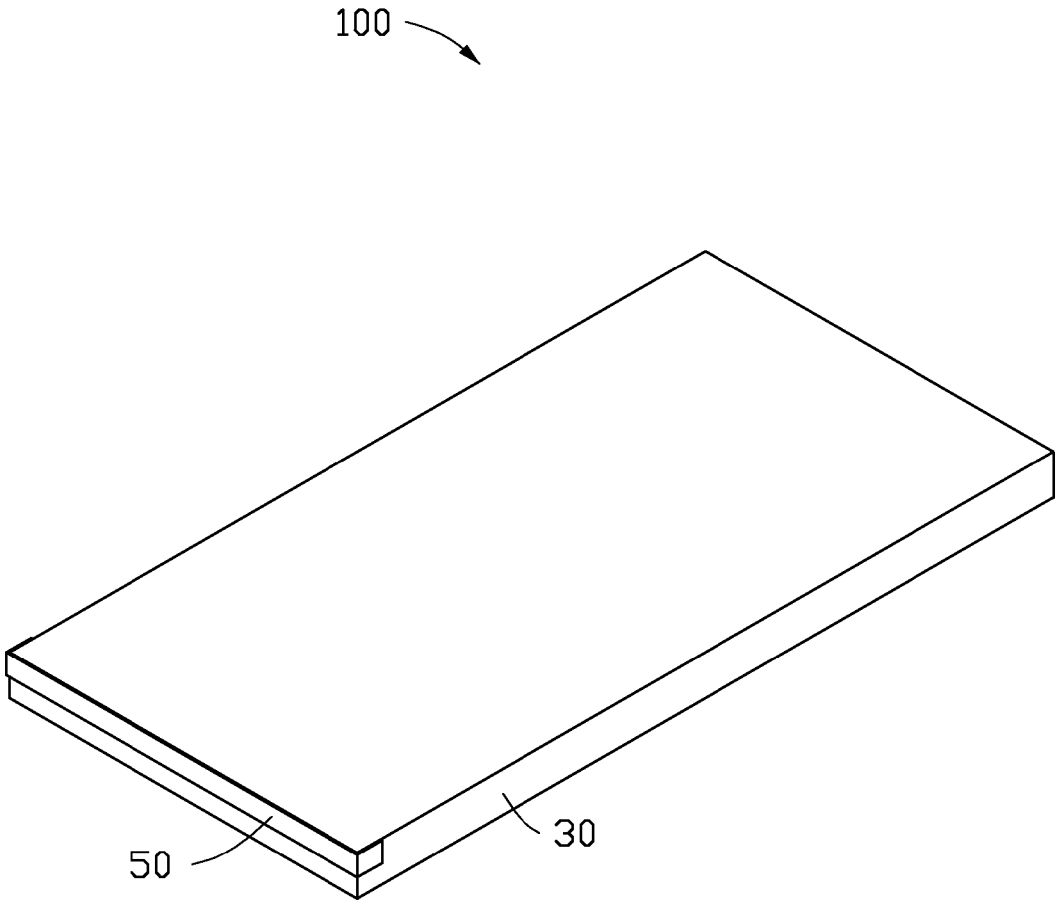
FIG. 1 is an isometric view of a wireless communication device employing an antenna structure, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

Figure 2:
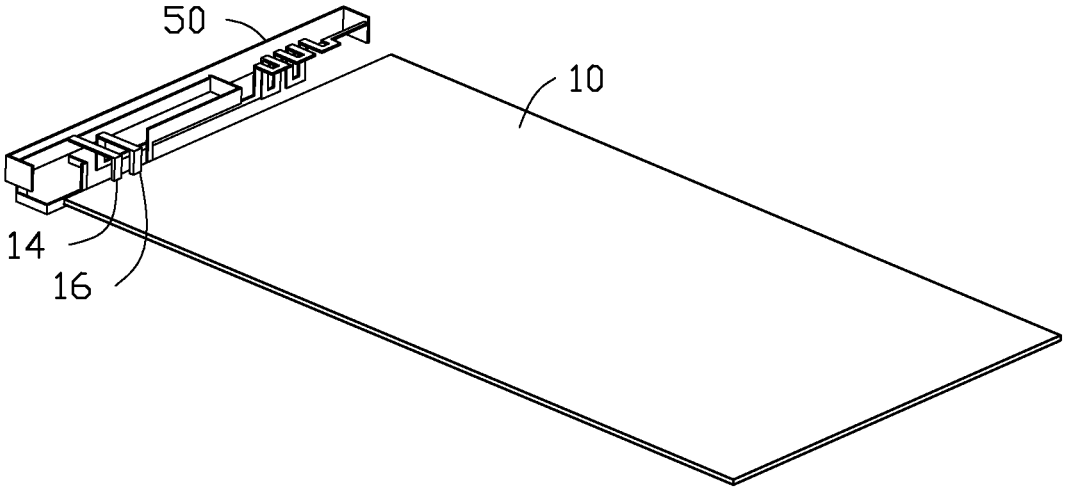
FIG. 2 is an isometric view of a part of the wireless communication device of FIG. 1.

FIGS. 1-2 illustrate an embodiment of a wireless communication device 100 employing an antenna structure 50, according to an exemplary embodiment. The wireless communication device 100 can be a mobile phone, a tablet, or an intelligent watch, for example (details not shown).

The wireless communication device 100 further includes a baseplate 10 and a housing 30 surrounding the baseplate 10 and coupled to the antenna structure 50. In at least one embodiment, the housing 30 may include a portion of metal frame.

The baseplate 10 can be a printed circuit board (PCB) of the wireless communication device 100. A feed pin 14 and a ground pin 16 are formed on the baseplate 10, the feed pin 14 is configured to provide current to the antenna structure 50, and the antenna structure 50 can be grounded by the ground pin 16.

Figure 3:
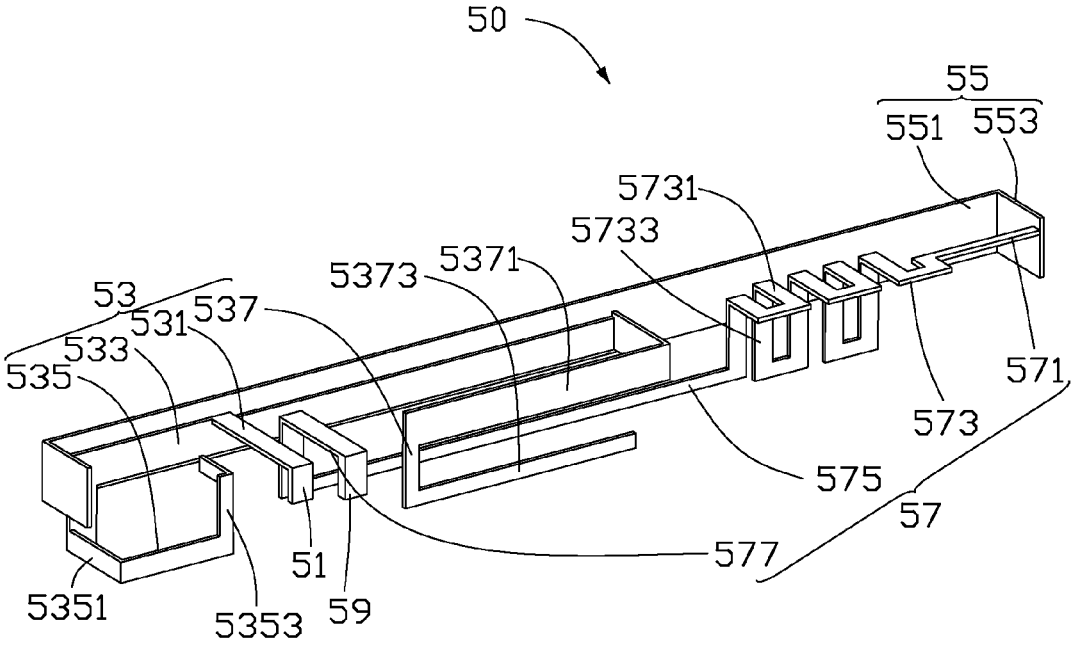
FIG. 3 is an isometric view of the antenna structure of FIG. 1.

FIG. 3 illustrates that the antenna structure 50 includes a feed end plate 51, a first radiator 53, a metallic plate 55, a second radiator 57, and a ground end plate 59. The first radiator 53 is coupled to the feed end plate 51 and is spaced from the metallic plate 55. The second radiator 57 is coupled to the metallic plate 55 and the ground end plate 59.

The feed end plate 51 is positioned perpendicular to the baseplate 10 and is coupled to the feed pin 14 to receive current.

The first radiator 53 includes a connection portion 531, a coupling portion 533, a first radiation portion 535, and a second radiation portion 537. In detail, the connection portion 531 is perpendicularly connected between the feed end plate 51 and the coupling portion 533 and extends away from the baseplate 10. The coupling portion 533 is substantially an L-shaped sheet, and the first radiation portion 535 and the second radiation portion 537 extend from two distal ends of the coupling portion 533.

The first radiation portion 535 includes a first extension section 5351 and a second extension section 5353. Both the first extension section 5351 and the second extension section 5353 are substantially an L-shaped sheet. A first end of the first extension section 5351 is perpendicularly connected to the coupling portion 533, and a second end of first extension section 5351 extends away from the coupling portion 533. A first end of the second extension section 5353 is connected to the first extension section 5351, and a second end of the second extension section 5353 extends towards the coupling portion 533.

The second radiation portion 537 includes a first additional section 5371 and a second additional section 5373. Both the first additional section 5371 and the second additional section 5373 are substantially L-shaped sheets, and a width of the first additional section 5371 is greater than a width of the second additional section 5373. A first end of the first additional section 5371 is perpendicularly connected to the coupling portion 533, and a second end of first additional section 5371 extends towards the connection portion 531. A first end of the second additional section 5373 is perpendicularly connected to the first additional section 5371, and a second end of the second additional section 5373 extends away from the connection portion 531. In at least one embodiment, the second end of the first extension section 5351, the first end of the second extension section 5353, and the second end of the first additional section 5371 are substantially positioned coplanar with the second additional section 5373.

Figure 4:
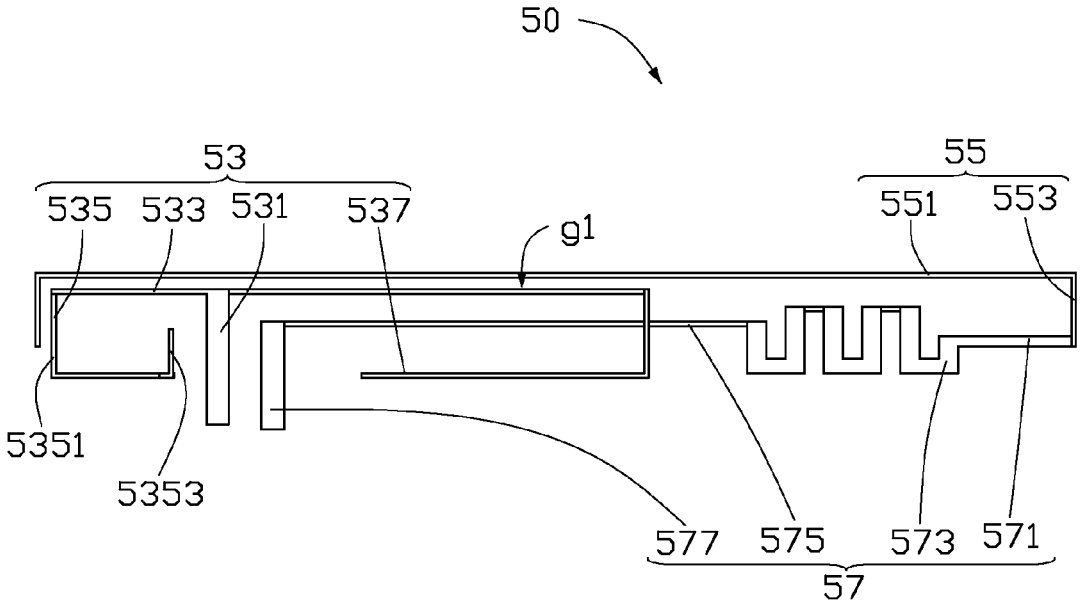
FIG. 4 is similar to FIG. 3, but shown from another angle.

FIG. 4 illustrates that the metallic plate 55 can be a portion of the housing 30, such as the metal frame of the housing 30. The metallic plate 55 includes a main sheet 551 and at least one side sheet 553. In at least one embodiment, the number of the side sheets 553 is two, and the two side sheets 553 are connected to two opposite ends of the main sheet 551. The main sheet 551 is parallel to the coupling portion 533, and a gap g1 is defined between the main sheet 551 and the coupling portion 533. Thus, current can flow from the coupling portion 533 to the metallic plate 55. In at least one embodiment, a width of the gap g1 can be about 0.8 mm.

The second radiator 57 includes a first connection section 571, a bent section 573, a second connection section 575, and a third connection section 577. The first connection section 571 is connected to one of the two side sheets 553 and extends parallel to the main sheet 551. The bent section 573 includes a plurality of first bent portions 5731 and a plurality of second bent portions 5733 connected to the first bent portions 5731. The first bent portions 5731 are positioned at a perpendicular plane to a plane of the main sheet 551, and are connected between the first connection section 571 and the second connection section 573. The second bent portions 5733 are positioned at a plane that is perpendicular to the plane of the first bent portions 5731. In at least one embodiment, both the first bent portions 5731 and the second bent portions 5733 are substantially U-shaped sheets, the number of the first bent portions 5731 is three, and the number of the second bent portions 5733 is two. The three first bent portions 5731 are separated from each other. The two second bent portions 5733 are positioned at a side of the first bent portions 5731 and are respectively connected between two adjacent first bent portions 5731. The second connection section 575 is substantially a U-shaped sheet and is connected between the first bent portion 5731 and the third connection sheet 577. The third connection sheet 577 is parallel to the connection portion 531 and is perpendicularly connected to the ground end plate 59.

The ground end plate 59 is coupled to the ground pin 16 of the baseplate 10 and is spaced from the feed end plate 51.

In at least one embodiment, a 2-dimensional (2D) size (length and width) of the baseplate 10 is about 140 mm by about 70 mm, and the baseplate 10 further defines a keep-out-zone (not shown) to carry the antenna structure 50. The purpose of the keep-out-zone is to delineate an area on the baseplate in which other electronic components (such as a camera, a vibrator, a speaker, etc.) cannot be placed. In at least one embodiment, a 2D size of the keep-out-zone is about 9.2 mm by about 70 mm, and a conductivity of the keep-out-zone is about 0.01 S/m.

Figure 5:
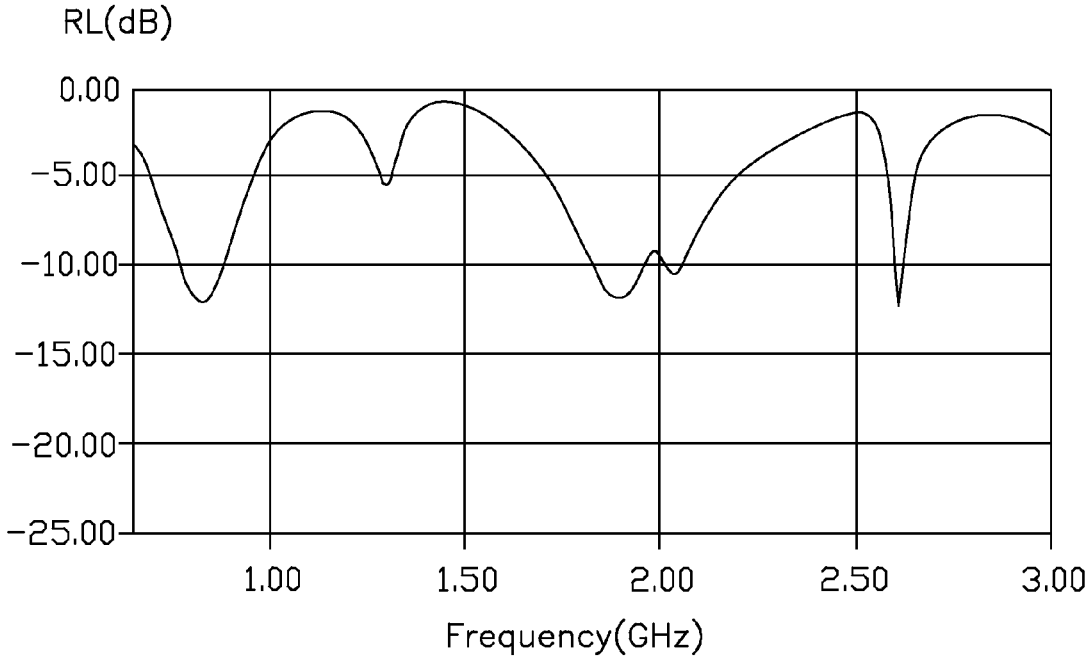
FIG. 5 is a return loss (RL) graph of the antenna structure of FIG. 3.

When current is input to the feed pin 14, the current flows to the coupling portion 533 via the feed end plate 51, and then is electronically coupled to the metallic plate 55. Thus, the current can continue to flow to the second radiator 57 and can be grounded by the ground end plate 59 and the ground pin 16 to form a first resonating current path with a low frequency mode. In at least one embodiment, a central frequency of the low frequency mode can be, for example, about 824 MHz. Additionally, the current flowing on the first radiator 53, the metallic plate 55, and the second radiator 57 resonates a first high frequency mode and a second high frequency mode due to frequency-doubled effect, such as 1 time frequency multiplication and 1.5 time frequency multiplication, for example. In at least one embodiment, a central frequency of the first high frequency mode can be, for example, about 1800 MHz, and a central frequency of the second high frequency mode can be, for example, about 2070 MHz. FIG. 5 illustrates a return loss (RL) of the antenna structure 50. In view of a RL curve shown on the FIG. 5, the wireless communication device 100 has good performance when operating at about 704 MHz to about 960 MHz and about 1710 to about 2170 MHz.

Figure 6:
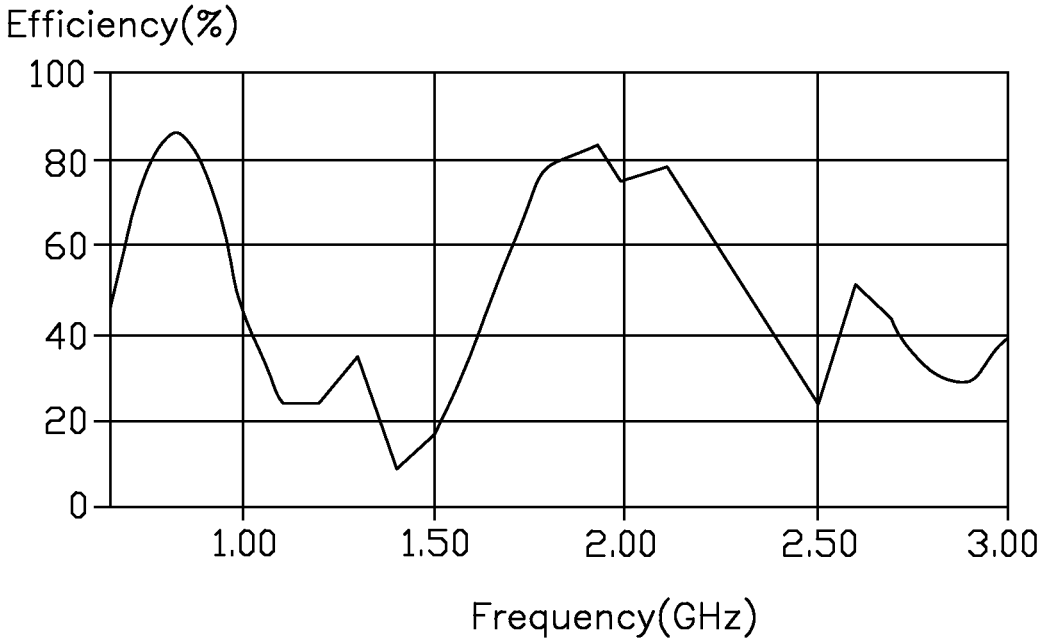
FIG. 6 is an antenna efficiency graph of the antenna structure of FIG. 3.

FIG. 6 is an antenna efficiency graph of the antenna structure 50. When the antenna structure 50 operates at about 704 MHz to about 960 MHz, the efficiency can be, for example, about 65% to about 85%. When the antenna structure 50 operates at about 1710 MHz to about 2170 MHz, the efficiency can be, for example, about 61% to about 82%.

Further, the low frequency mode can be fine tuned by increasing or decreasing the number of the first bent portions 5731 and the second bent portions 5733. Moreover, the first high frequency mode and the second high frequency mode can also be fine tuned by changing a length of the first radiator 53.

In summary, the first radiator 53 is electronically coupled to the metallic plate 55, thus, the housing 30 can be served as a part of the antenna structure 50, which allows further size reductions of the wireless communication device 100 employing the antenna structure 50. Additionally, the wireless communication device 100 employing the antenna structure 50 can be used in a plurality of (more than two) common wireless communication systems, such as GSM, WCDMA, LTE, and other 2G/3G/4G systems, with acceptable communication quality.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a feed end plate;

a ground end plate;

a first radiator coupled to the feed end plate;

a second radiator coupled to the ground end plate; and a metallic plate spaced from the first radiator and coupled to the second radiator;

wherein the metallic plate comprises a main sheet and at least one side sheet connected to the main sheet, a gap is defined between the main sheet and the first radiator, and the second radiator is coupled to the at least one side sheet;

wherein the first radiator comprises a coupling portion, a connection portion, a first radiation portion, and a second radiation portion, the gap is defined between the main sheet and the coupling portion, the connection portion is perpendicularly connected between the feed end plate and the coupling portion, the first radiation portion and the second radiation portion extend from two distal ends of the coupling portion.

2. The antenna structure as claimed in claim 1, wherein the first radiation portion comprises a first extension section and a second extension section, a first end of the first extension section is perpendicularly connected to the coupling portion, and a second end of first extension section extends away from the coupling portion, a first end of the second extension section is connected to the first extension section, and a second end of the second extension section extends towards the coupling portion.

3. The antenna structure as claimed in claim 2, wherein the second radiation portion comprises a first additional section and a second additional section, a first end of the first additional section is perpendicularly connected to the coupling portion, and a second end of first additional section extends towards the connection portion, a first end of the second additional section is perpendicularly connected to the first additional section, and a second end of the second additional section extends away from the connection portion.

4. The antenna structure as claimed in claim 3, wherein the second end of the first extension section, the first end of the second extension section, and the second end of the first additional section are substantially positioned coplanar with the second additional section.

5. The antenna structure as claimed in claim 1, wherein the second radiator comprises a first connection section, the first connection section is connected to the at least one side sheet and extends parallel to the main sheet.

6. The antenna structure as claimed in claim 5, wherein the second radiator further comprises a bent section having a plurality of first bent portions and a plurality of second bent portions connected to the first bent portions, the first bent portions are positioned at a plane that is perpendicular to a plane of the main sheet and are connected to the first connection section, the second bent portions are positioned at a plane that is perpendicular to the plane of the first bent portions.

7. The antenna structure as claimed in claim 6, wherein the second radiator further comprises a second connection section and a third connection section, the second connection section is connected between the first bent portion and the third connection sheet, and the third connection sheet is perpendicularly connected to the ground end plate.

8. A wireless communication device comprising a housing and an antenna structure, the antenna structure comprising:

a feed end plate;

a ground end plate;

a first radiator coupled to the feed end plate; and a second radiator coupled to the ground end plate;

wherein the housing comprises a metal frame spaced from the first radiator and coupled to the second radiator; the metal frame comprises a main sheet and at least one side sheet connected to the main sheet, a gap is defined between the main sheet and the first radiator, and the second radiator is coupled to the at least one side sheet;

wherein the first radiator comprises a coupling portion, a connection portion, a first radiation portion, and a second radiation portion, the gap is defined between the main sheet and the coupling portion, the connection portion is perpendicularly connected between the feed end plate and the coupling portion, the first radiation portion and the second radiation portion extend from two distal ends of the coupling portion.

9. The wireless communication device as claimed in claim 8, wherein the first radiation portion comprises a first extension section and a second extension section, a first end of the first extension section is perpendicularly connected to the coupling portion, and a second end of first extension section extends away from the coupling portion, a first end of the second extension section is connected to the first extension section, and a second end of the second extension section extends towards the coupling portion.

10. The wireless communication device as claimed in claim 9, wherein the second radiation portion comprises a first additional section and a second additional section, a first end of the first additional section is perpendicularly connected to the coupling portion, and a second end of first additional section extends towards the connection portion, a first end of the second additional section is perpendicularly connected to the first additional section, and a second end of the second additional section extends away from the connection portion.

11. The wireless communication device as claimed in claim 10, wherein the second end of the first extension section, the first end of the second extension section, and the second end of the first additional section are substantially positioned coplanar with the second additional section.

12. The wireless communication device as claimed in claim 8, wherein the second radiator comprises a first connection section, the first connection section is connected to the at least one side sheet and extends parallel to the main sheet.

13. The wireless communication device as claimed in claim 12, wherein the second radiator further comprises a bent section having a plurality of first bent portions and a plurality of second bent portions connected to the first bent portions, the first bent portions are positioned at a plane that is perpendicular to a plane of the main sheet and are connected to the first connection section, the second bent portions are positioned at a plane that is perpendicular to the plane of the first bent portions.

14. The wireless communication device as claimed in claim 13, wherein the second radiator further comprises a second connection section and a third connection section, the second connection section is connected between the first bent portion and the third connection sheet, and the third connection sheet is perpendicularly connected to the ground end plate.

* * * * *